US006358335B1

(12) United States Patent
Ohmori et al.

(10) Patent No.: US 6,358,335 B1
(45) Date of Patent: Mar. 19, 2002

(54) CONTINUOUS CASTING SLAB SUITABLE FOR THE PRODUCTION OF NON-TEMPERED HIGH TENSILE STEEL MATERIAL

(75) Inventors: Akio Ohmori; Fumimaru Kawabata; Keniti Amano, all of Kurashiki (JP)

(73) Assignee: Kawasaki Steel Corporation, Kobe (JP)

( * ) Notice: Subject to any disclaimer, the term of this patent is extended or adjusted under 35 U.S.C. 154(b) by 0 days.

(21) Appl. No.: 09/515,654

(22) Filed: Feb. 29, 2000

(30) Foreign Application Priority Data

Mar. 10, 1999 (JP) ..... 11-062753

(51) Int. Cl.[7] ..... C22C 38/42
(52) U.S. Cl. ..... 148/328; 148/624
(58) Field of Search ..... 420/8, 83, 89, 420/93, 121, 127, 128; 148/328, 622, 624

(56) References Cited

U.S. PATENT DOCUMENTS

| | | | | |
|---|---|---|---|---|
| 4,025,368 | A | * | 5/1977 | Sanbongi et al. |
| 5,336,339 | A | * | 8/1994 | Yamamoto et al. |
| 5,622,572 | A | * | 4/1997 | Wells, Jr. et al. |
| 5,743,972 | A | * | 4/1998 | Kimura et al. |

FOREIGN PATENT DOCUMENTS

| | | | |
|---|---|---|---|
| EP | 0 940 477 A1 | | 9/1999 |
| JP | 39-2368 | | 3/1964 |
| JP | 56123350 A | * | 9/1981 |
| JP | 59200741 A | * | 11/1984 |
| JP | A-1-186848 | | 7/1989 |
| JP | A-8-197102 | | 8/1996 |
| JP | A-10-68016 | | 3/1998 |
| JP | A-10-88230 | | 4/1998 |
| JP | A-10-88275 | | 4/1998 |
| JP | 10096043 A | * | 4/1998 |
| JP | A-10-306315 | | 11/1998 |

OTHER PUBLICATIONS

Kouichi Uchino et al., "Report of Japan Iron and Steel Society," The Iron and Steel Institute of Japan, vol. 77, 1999, No. 1, pp. 171–178.

* cited by examiner

*Primary Examiner*—Roy King
*Assistant Examiner*—Harry D. Wilkins, III
(74) *Attorney, Agent, or Firm*—Oliff & Berridge, PLC

(57) ABSTRACT

N—V(nitrogen-vanadium) containing continuous casting slab with no surface cracks suitable for the manufacture of non-tempered high tensile steel materials has a tensile strength of 490 MPa or more and excellent toughness. A method of manufacturing non-tempered high tensile steel materials uses the casting slab as the raw material. Compatibility between the desired properties of the materials utilizing VN and inhibition of the surface cracks of test pieces, can be attained by controlling the steel composition and the relationship between each of components of the steel thereby controlling precipitation of VN and MnS. A continuous casting slab with no surface cracks contains C, Si, Mn, P, S, Al, V, N, Ti, B, Ca and REM each within a specified range, and satisfies an equation for the relationship between V and N and a relationship between Mn and S.

13 Claims, 1 Drawing Sheet

FIGURE
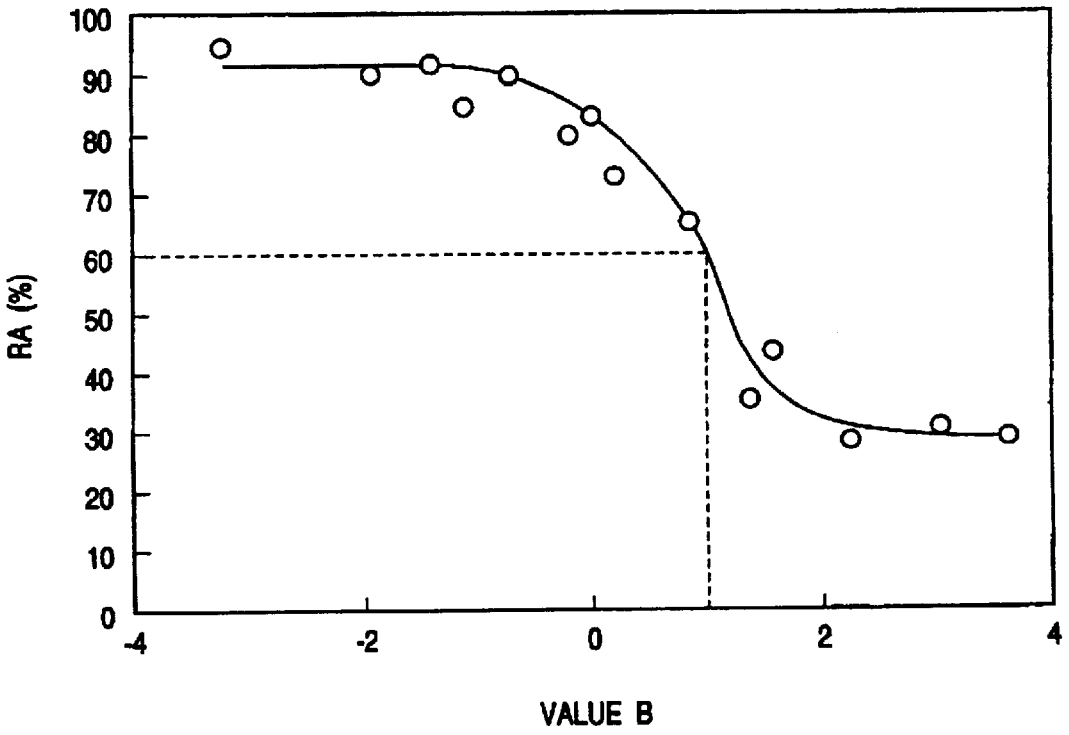

CONTINUOUS CASTING SLAB SUITABLE FOR THE PRODUCTION OF NON-TEMPERED HIGH TENSILE STEEL MATERIAL

BACKGROUND OF THE INVENTION

1. Field of Invention

The present invention is directed to continuous casting slab suitable for the production of non-tempered high tensile steel materials having high tensile strength and excellent toughness. The present invention is also directed to a method of manufacturing non-tempered high tensile steel materials using the casting slab as the raw material.

2. Description of Related Art

As a method of manufacturing steel materials having characteristics such as strength, toughness and weldability in good balance, a method of refining structures with TMCP (Thermo-Mechanical Control Process) is known.

However, for fully providing the effect of rolling in a non-recrystallization temperature range to attain the refinement of the structures by such a method, large rolling reduction must be applied at a low temperature range. This results in problems such as (a) a large load is imposed on a rolling mill, (b) a sufficient draft ratio cannot be ensured for materials of large thickness, and (c) waiting time for the temperature control increases to lower the rolling efficiency. Unless such problems are overcome, no effective refinement of the structures can be attained that also improves the characteristics such as strength, toughness and weldability.

In addition to the refinement of the structures, a technique is known that utilizes the function of forming intra-granular ferrite nuclei and the precipitation hardening function of VN (vanadium nitride) precipitated in steels. For example, Japanese Patent Publication No. 2368/1964 and the Report of Japan Iron and Steel Society (Iron and Steel, vol. 77, 1991, No. 1, page 171) disclose the technique of refining the structures by adding a large amount of N together with V to improve the strength and the toughness.

In addition, Japanese Patent Laid-Open No. 186848/1989 discloses a technique of dispersing composite precipitates of TiN-MnS-VN with the addition of Ti, thereby effectively providing the ferrite forming function with VN acting as ferrite nucleation site, thereby improving the toughness in weld heat affected zones. Further, Japanese Patent Laid-Open No. 125140/1997 (U.S. Pat. No. 5,743,972) discloses a method of manufacturing wide beam flanges of large thickness that is excellent in toughness and material homogeneity by the composite addition of V and N and by ferrite grain size control.

However, in the case of continuously casting V (vanadium) containing steel slabs, cracks such as transverse facial cracks or corner cracks tend to occur on the surface of the casting slab upon bending or unbending. These cracks make it difficult to obtain continuous casting slabs of excellent surface quality. If such cracks are formed on the surface of the continuous casting slab, a direct rolling process of directly feeding high-temperature continuous casting slabs with no surface treatment to a hot rolling step cannot be applied and the production cost consequently increases. For preventing surface cracks in continuous casting slabs of V containing steels, it has been known to be effective to reduce the N (nitrogen) content and, further, forming TiN with the addition of Ti, thereby trapping N. However, because the amount of N in the steels required for forming VN is insufficient in such methods, the function of forming intra-granular ferrite nuclei for VN and precipitation hardening ability cannot be utilized effectively.

SUMMARY OF THE INVENTION

In view of the above-described problems of the known art, an object of the present invention is to provide a continuous casting slab with no surface cracks while containing VN in the steels.

It is also an object of the present invention to provide a method of manufacturing non-tempered high tensile steel materials having favorable toughness by using the continuous casting slab.

The material properties that can be provided in embodiments of the steel materials according to the invention are: yield strength (YS) of about 325 MPa or more, tensile strength (TS) of about 490 MPa or more, Charpy impact absorption energy at −20° C. (vE-20) of about 200 J or more, and impact absorption energy at 0° C. (vE0) in weld heat affected zones of about 110 J or more. In some preferred embodiments of the steel materials, the tensile strength can be 520 MPa or more.

The present inventors have attained a compatibility between the material properties and the inhibition of surface cracks of the casting slab that has been difficult to obtain. Particularly, by controlling the steel composition, and by controlling the relation between each of the specific components of the compositions, the precipitation of VN and MnS can be controlled.

The invention provides a steel continuous casting slab with no surface cracks comprising: C: about 0.05 to 0.18 wt %, Si: about 0.6 wt % or less, Mn; about 0.80 to 1.80 wt %, P: about 0.030 wt % or less, S: about 0.004 wt % or less, Al: about 0.050 wt % or less, V: about 0.04 to 0.15 wt % and N: about 0.0050 to 0.0150 wt %, and at least one of Ti: about 0.004 to 0.030 wt % and B: about 0.0003 to 0.0030 wt % within a range satisfying the equation (1) below; and further comprising at least one of Ca: about 0.0010 to 0.0100 wt % and REM: about 0.0010 to 0.0100 wt % within a range satisfying the equation (2) below; with the balance being iron and inevitable impurities:

$$5.0 \leqq [V](\text{wt }\%)/([N](\text{wt }\%)-0.292\times[Ti](\text{wt }\%)-1.295\times[B](\text{wt }\%)) \leqq 18.0 \quad (1)$$

$$[Mn](\text{wt }\%)\times([S](\text{wt }\%)-0.8\times([Ca](\text{wt }\%)-110\times[Ca](\text{wt }\%)\times[O](\text{wt }\%))-0.25\times([REM](\text{wt }\%)-70\times[REM](\text{wt }\%)\times[O](\text{wt }\%)))\times 10^3 \leqq 1.0 \quad (2)$$

Further, the steel can also comprise Cu, Ni, Cr, Mo and Nb.

Further, the invention provides a method of manufacturing non-tempered high tensile steel materials. Exemplary embodiments of the method according to the invention comprise heating the continuous casting slab at a temperature of from about 1050° to 1250° C., and applying hot working with a cumulative draft of 30% or more within a temperature range of from about 1050° to 950° C.

BRIEF DESCRIPTION OF THE DRAWINGS

The FIGURE is a graph showing the effect, on the reduction value (RA) in a high temperature tensile test, of a value B given by: $[Mn](\text{wt }\%)\times([S](\text{wt }\%)-0.8\times[Ca](\text{wt }\%)-110\times[Ca](\text{wt }\%)\times[O](\text{wt }\%))-0.25\times([REM](\text{wt }\%)-70\times[REM](\text{wt }\%)\times[O](\text{wt }\%)))\times 10^3)$.

DETAILED DESCRIPTION OF PREFERRED EMBODIMENTS

The present invention provides compatibility between material properties and the inhibition of surface cracks of casting slabs, which has been previously difficult to achieve. The present invention controls the steel composition and also the relation between each of specific components of the composition, thereby controlling the precipitation of VN and MnS. Specifically, the invention is based on the following findings that have been obtained by various experiments and studies by the inventors.

(1) Surface cracks often formed during the continuous casting of V-N containing steel slabs along austenite grain boundaries. Accordingly, the sensitivity to cracks can be reduced by the present invention by controlling the grain boundary precipitation of VN.

(2) When TiN or BN dispersed in steels function as precipitation sites for VN, it is possible to uniformly precipitate VN and also reduce the grain boundary precipitation of VN. This effect can be attained by adding V, N, Ti, B or the like with such a good balance so as to establish a predetermined relation between each of the elements.

(3) Sulfur in the steels segregates to the austenite grain boundaries, which reduces the grain boundary strength and increases the sensitivity to cracks. Further, MnS precipitated along the austenite grain boundaries functions as VN precipitation sites to promote grain boundary precipitation of VN and further increase the sensitivity to cracks at the grain boundaries. Grain boundary deposition of MnS and VN tends to cause surface cracking of the continuous casting slab. Accordingly, in the present invention, the S content is desirably reduced to be as low as possible. Further, because S is trapped as sulfides by adding Ca or REM, the amount of MnS segregating along the austenite grain boundaries can be decreased.

The composition of the continuous casting slab according to the present invention is described as follows.

C: 0.05 to 0.18 wt %

C increases the strength of steels. For ensuring a desired strength level, C should be added in an amount of 0.05 wt % or more. However, when C is added in excess of 0.18 wt %, the toughness and the weldability of materials are deteriorated and the toughness in the heat affected zone formed by welding is also deteriorated. Accordingly, in embodiments, the C content is within the range of from about 0.05 to 0.18 wt %. In some preferred embodiments, the C content is from about 0.08 to 0.16 wt %.

Si: 0.6 wt % or Less

Si acts as a deoxidizer and contributes to an increase of the steel strength by solid-solution hardening. However, an addition in excess of 0.6 wt % of Si remarkably deteriorates the weldability of products and also the toughness in the heat affected zones formed by welding. Accordingly, the Si content should be 0.6 wt % or less.

Mn: 0.80 to 1.80 wt %

Mn increases the strength of steels. In order to ensure a desired strength level, Mn should be added in an amount of 0.80 wt % or more. However, when Mn is added in an amount in excess of 1.80 wt %, the structure of the products changes from mainly comprising ferrite+pearlite to mainly comprising low temperature transformation products such as bainite, which reduces the toughness of the products. Accordingly, in embodiments, the Mn content is within the range from 0.80 to 1.80 wt %. In some preferred embodiments, the Mn content is from about 1.00 to 1.70 wt %.

P: 0.030 wt % or Less

Because P deteriorates the toughness of the products and in the heat affected zones formed by welding, the P content is desirably as low as possible. Up to about 0.030 wt % of P is permissible. Accordingly, in embodiments, the P content is about 0.030 wt % or less. In some preferred embodiments, the P content is about 0.020 wt % or less.

S: 0.004 wt % or Less

S promotes the precipitation of VN to refine the structure. However, S also tends to cause surface cracks on casting slabs by segregation to the austenite grain boundaries or by MnS formation on the grain boundaries. Accordingly, in embodiments, the S content is about 0.004 wt % or less.

Al: 0.050 wt % or Less

Al acts as a deoxidizer. However, when Al is added in a large amount, non-metal inclusion formation increases, which deteriorates the cleanness and the toughness. Further, Al is likely to be bonded with N to form AlN, which inhibits stable precipitation of VN. Accordingly, in embodiments, the Al content is about 0.050 wt % or less.

V: 0.04 to 0.15 wt %

V has an important role in the invention. V is bonded with N to form nitrides, which are precipitated in austenite during hot working or subsequent cooling. VN acts as ferrite nucleation site and contributes to the refinement of ferrite crystal grains. As a result, the toughness of the products is improved. Further, because vanadium carbo-nitride is precipitated also in the ferrite after transformation, the strength of products can be improved without compulsory cooling. Because compulsory cooling is not necessary upon cooling, properties can be kept uniform along the thickness of the plate and neither residual stresses nor residual strains are produced. For effectively providing these effects, the V content needs to be about 0.04 wt % or more. However, when V is added in an amount in excess of about 0.15 wt %, the toughness and the weldability of the products and the heat affected zones formed by welding are deteriorated. Accordingly, in embodiments, V is added in an amount in the range from about 0.04 to 0.15 wt %. In some preferred embodiments, an amount of V added is from about 0.04 to 0.12 wt %.

N: 0.0050 to 0.0150 wt %

N is bonded with V and/or Ti to form nitrides. The nitrides suppress the growth of austenite grains upon heating of slabs. Further, the nitrides also act as ferrite nucleation site. Consequently, the ferrite crystal grains are refined and the toughness of the products is improved. For effectively providing these effects, N needs to be added in an amount of about 0.0050 wt % or more. However, when N is added in an amount in excess of about 0.0150 wt %, the solid solubilizing amount of N increases, which greatly deteriorates the toughness and the weldability of the products. Accordingly, in embodiments, the N content is from about 0.0050 to 0.0150 wt %. In some preferred embodiments, the N content is from about 0.0060 to 0.0120 wt %.

Ti: 0.004 to 0.030 wt %

Ti is bonded with N to form TiN. TiN suppresses the growth of the austenite grains during heating of slabs and also functions as VN precipitating sites. That is, when TiN is finely dispersed in the steels, VN can precipitate uniformly to suppress grain boundary cracks on the surface of the continuous casting slab. For attaining such an effect, Ti needs to be added in an amount of about 0.004 wt % or more. However, if Ti is added in an amount in excess of about 0.030 wt % the cleanness of the steel is deteriorated and precipitation of VN is significantly suppressed. Accordingly, in embodiments, Ti is added in an amount within the range of from about 0.004 to 0.030 wt %. In sore preferred embodiments, the Ti content is within the range of from about 0.005 to 0.020 wt %.

B: 0.0003 to 0.0030 wt %

B suppresses grain boundary formation of film-like ferrite along the austenite grain boundaries, which lowers the sensitivity to cracks at the grain boundaries. Further, B promotes the formation of intra-grain ferrite to refine the structure. For attaining these effects, B needs to be added in an amount of about 0.0003 wt % or more. However, if B is added in an amount in excess of about 0.0030 wt %, the toughness of the products is deteriorated. Accordingly, in embodiments, the amount of B is from about 0.0003 to 0.0030 wt %. A preferred amount of B is from about 0.0005 to 0.0020 wt %.

Ca: 0.0010 to 0.0100 wt %, REM: 0.0010 to 0.0100 wt %

Both of Ca and REM (rare earth metal) form stable sulfides at a high temperature to trap S in the steels. As a result, because Ca and REM reduce solid solubilized S segregating along the austenite grain boundaries, they contribute to lowering of the sensitivity to cracks on the surface of the continuous casting slab. Further, Ca and REM suppress the growing of austenite grains during slab heating to refine the ferrite grains after rolling. In addition, Ca and REM also have an effect of improving the toughness of the heat affected zones formed by welding. For attaining these effects, each of Ca and REM need to be added in an amount of about 0.0010 wt % or more. However, when Ca and REM are added in an amount in excess of about 0.0100 wt %, they deteriorate the cleanness of the steels and the toughness of the products. Accordingly, both of Ca and REM are added in an amount of from 0.0010 to 0.0100 wt %.

Cu: 0.05 to 0.50 wt %, Ni: 0.05 to 0.50 wt %, Cr: 0.05 to 0.50 wt %, Mo: 0.02 to 0.20 wt %

Each of the elements Cu, Ni, Cr and Mo increases the strength of the slabs by improving the hardenability. These elements are added optionally. For providing this effect, each of Cu, Ni and Cr needs to be added in an amount of about 0.05 wt % or more, and Mo needs to be added in an amount of about 0.02 wt % or more. However, even if each of Cu and Ni is added in an amount in excess of about 0.50 wt %, their effect does not further improve and it is also economically disadvantageous. Cr and Mo deteriorate the weldability and the toughness when added in excess of about 0.50 wt % and about 0.20 wt %, respectively. Accordingly, in embodiments, each of Cu, Ni and Cr is added in an amount within the range of from about 0.05 to 0.50 wt %, and Mo is added in an amount of within the range of from about 0.02 to 0.20 wt %.

Nb: 0.003 to 0.030 wt %

Nb improves both the strength and the toughness of the slabs by the structure refining effect and the precipitation hardening effect. Further, as also for Ti, Nb also promotes precipitation of VN. To provide these effects, Nb needs to be added in an amount of about 0.003 wt % or more. However, when Nb is added in an amount in excess of about 0.030 wt %, the weldability of the products and the toughness of the heat affected zones formed by welding are deteriorated. Accordingly, Nb is added within the range of from about 0.003 to 0.030 wt %.

$$5.0 \leqq [V](wt\ \%)/([N](wt\ \%)-0.292\times[Ti](wt\ \%)-1.295\times[B](wt\ \%)) \leqq 18.0$$

[V](wt %)/([N](wt %)−0.292×[Ti](wt %)−1.295×[B](wt %)) (hereinafter referred to as "the value A") represents the relationship between the amount of V and the amount of N that can be bonded with the V. If the value A is less than about 5.0, because the amount of solid solubilized N increases, cracks tend to be formed on the surface of continuous casting slabs. Further, an increase in the amount of solid solubilized N deteriorates the toughness of the heat affected zones or causes strain aging. When the value A exceeds about 18.0, because VC is formed in a large amount, it increases the sensitivity to cracks on the surface of casting slabs and deteriorates the toughness of the products. Accordingly, in embodiments, the value A is within the range of from about 5.0 to 18.0. A preferred range for the value A is from about 6.0 to 12.0.

$$[Mn](wt\ \%)\times([S](wt\ \%)-0.8\times([Ca](wt\ \%)-110\times[Ca](wt\ \%)\times[O](wt\ \%))-0.25\times([REM](wt\ \%)-70\times[REM](wt\ \%)\times[O](wt\ \%)))\times 10^3<1.0$$

[Mn](wt %)×([S](wt %)−0.8×[Ca](wt %)−110×[Ca](wt %)×[O](wt %))−0.25×([REM](wt %)−70×[REM](wt %)×[O](wt %)))×$10^3$ (hereinafter referred to as "the value B") represents the relationship between the amount of Mn and S that can be bonded therewith. If the value B exceeds about 1.0, because a large amount of MnS precipitates along the austenite grain boundaries during continuous casting, surface cracks tend to form along the grain boundaries. Accordingly, it is necessary to restrict the value B to about 1.0 or less.

To demonstrate the importance of restricting the value B to about 1.0 or less, a plurality of steels containing 0.14 wt % C–0.35 wt % Si–1.45 wt % Mn–0.015 wt % P–0.020 wt % Al–0.06 wt % V–0.007 wt % Ti–0.007 wt % N as the basic components with the amount of S, Ca and REM being varied were fabricated into test specimens of round bars of 8 mmϕ and a high temperature tensile test was conducted. The high temperature tensile test was conducted at a strain rate of $10^{-4}s^{-1}$ after heating the test specimens at 1350° C. to solid solubilize additive elements and then cooling them to 900° C. The condition is selected for reproducing tensile strains that the surface of the casting slab undergoes during continuous casting. FIGURE shows the relationship between the reduction value (RA) determined by the high temperature tensile test and the value B. It can be seen from the FIGURE that when the value B is 1.0 or less, RA is 60% or more to provide excellent ductility.

A method of manufacturing non-tempered high tensile steel materials is described as follows.

A continuous casting slab is adjusted for the components and are heated to 1050° C. to 1250° C. When the heating temperature of the casting slab is lower than about 1050° C., precipitation elements such as V and Nb are not sufficiently solid solubilized, so that the effect of the precipitation elements cannot be provided effectively. In addition, because the deformation resistance increases, it is difficult to ensure the rolling reduction in hot rolling. On the other hand, if the casting slabs are heated at a temperature in excess of about 1250° C., austenite grains become remarkably coarse. Further, scale loss increase causes frequent furnace repair. Accordingly, the heating temperature for the casting slab is within the range of from about 1050° C. to 1250° C.

Then, hot working is applied to the heated casting slab such that the cumulative draft is 30% or more within the temperature range of about 950° C. to 1050° C. Austenite is recrystallized and refined by the hot working at 1050° C. to 950° C. Dislocations introduced upon hot working promote and unify the precipitation of VN. If the cumulative draft is less than 30%, no sufficient refinement can be attained and no appropriate precipitation of VN can be obtained.

EXAMPLES

Steels having the chemical compositions shown in TABLE 1 below were melted in a converter into slabs by a continuous casting process and the presence or absence of surface cracks was confirmed.

TABLE 1

| Steel | Chemical Composition (wt %) | | | | | | | | | | | | |
|---|---|---|---|---|---|---|---|---|---|---|---|---|---|
| No. | C | Si | Mn | F | S | Al | V | N | O | B | Ti | Cn | REM |
| A | 0.14 | 0.40 | 1.35 | 0.012 | 0.0006 | 0.022 | 0.066 | 0.0071 | 0.0016 | 0.0001 | 0.007 | 0.0028 | |
| B | 0.12 | 0.38 | 1.48 | 0.013 | 0.0013 | 0.018 | 0.072 | 0.0098 | 0.0022 | 0.0007 | 0.006 | 0.0025 | |
| C | 0.13 | 0.36 | 1.32 | 0.011 | 0.0009 | 0.020 | 0.068 | 0.0103 | 0.0018 | 0.0002 | 0.008 | | 0.0056 |
| D | 0.15 | 0.28 | 1.25 | 0.010 | 0.0028 | 0.028 | 0.052 | 0.0090 | 0.0017 | 0.0019 | 0.010 | 0.0037 | |
| E | 0.08 | 0.41 | 1.55 | 0.014 | 0.0033 | 0.024 | 0.066 | 0.0092 | 0.0023 | 0.0002 | 0.009 | 0.0035 | 0.0044 |
| F | 0.08 | 0.39 | 1.60 | 0.015 | 0.0018 | 0.025 | 0.072 | 0.0076 | 0.0030 | 0.0003 | 0.007 | 0.0032 | |
| G | 0.12 | 0.42 | 1.44 | 0.014 | 0.0011 | 0.026 | 0.058 | 0.0092 | 0.0028 | 0.0001 | 0.012 | 0.0044 | |
| H | 0.14 | 0.34 | 1.33 | 0.012 | 0.0021 | 0.028 | 0.160 | 0.0108 | 0.0020 | 0.0001 | 0.005 | 0.0033 | |
| I | 0.13 | 0.20 | 1.55 | 0.012 | 0.0012 | 0.023 | 0.051 | 0.0119 | 0.0018 | 0.0001 | 0.004 | 0.0021 | 0.0062 |
| J | 0.15 | 0.24 | 1.45 | 0.019 | 0.0028 | 0.027 | 0.066 | 0.0156 | 0.0020 | 0.0016 | 0.005 | 0.0036 | |
| K | 0.13 | 0.21 | 1.37 | 0.017 | 0.0018 | 0.029 | 0.050 | 0.0120 | 0.0018 | 0.0001 | 0.005 | 0.0045 | |
| L | 0.15 | 0.41 | 1.30 | 0.011 | 0.0023 | 0.030 | 0.063 | 0.0088 | 0.0024 | 0.0025 | 0.009 | 0.0025 | 0.0058 |
| M | 0.12 | 0.40 | 1.45 | 0.010 | 0.0007 | 0.017 | 0.070 | 0.0097 | 0.0019 | 0.0001 | 0.020 | 0.0022 | |
| N | 0.12 | 0.25 | 1.31 | 0.014 | 0.0033 | 0.023 | 0.059 | 0.0072 | 0.0021 | 0.0008 | 0.005 | 0.0012 | |
| O | 0.14 | 0.38 | 1.42 | 0.015 | 0.0012 | 0.026 | 0.064 | 0.0087 | 0.0016 | 0.0002 | 0.015 | | 0.0015 |
| P | 0.14 | 0.45 | 1.36 | 0.015 | 0.0045 | 0.026 | 0.088 | 0.0095 | 0.0018 | 0.0003 | 0.006 | 0.0041 | |

| Steel | Chemical Composition (wt %) | | | | | Value | Value | Surface crack | |
|---|---|---|---|---|---|---|---|---|---|
| No. | Cu | Ni | Cr | Mo | Nb | A | B | of casting slab | Note |
| A | | | | | | 13.4 | −1.68 | none | Inventive Example |
| B | | | | | | 10.1 | −0.32 | none | " |
| C | 0.20 | 0.10 | | | | 8.8 | −0.30 | none | " |
| D | | 0.22 | | | | 14.4 | 0.49 | none | " |
| E | | | 0.18 | | | 10.5 | 0.56 | none | " |
| F | | | | 0.12 | | 13.9 | 0.14 | none | " |
| G | | | | | 0.015 | 10.4 | −1.92 | none | " |
| H | | | | | | 17.4 | 0.05 | yes | Comparative Example |
| I | 0.12 | 0.06 | | | | 4.8 | −2.16 | yes | " |
| J | | | | | 0.011 | 5.5 | 0.80 | yes | " |
| K | | | 0.15 | | | 4.8 | −1.49 | yes | " |
| L | | | | 0.08 | | 21.8 | −0.37 | yes | " |
| M | | | | | | 18.8 | −1.00 | yes | " |
| N | | 0.11 | 0.22 | | | 12.5 | 3.36 | yes | " |
| O | 0.28 | 0.30 | | | | 15.8 | 1.27 | yes | " |
| P | 0.22 | 0.15 | | | | 12.0 | 2.54 | yes | " |

Value A = [V] (wt %)/([N] (wt %) − 0.292 × [T1] (wt %) − 1.295 × [B] (wt %))
Value B = [Mn] (wt %) × ([S] (wt %) − 0.8 × ([Ca] (wt %) − 110 × [Ca] (wt %) × [O] (wt %)) − 0.25 × ([REM] (wt %) − 70 × [REM] (wt %) × [O] (wt %)) × $10^3$ Then the slabs were heated and hot rolled under the conditions shown in TABLE 2 below to form steel plates with a thickness from 40 to 80 mm. After rolling, cooling was conducted by air cooling.

TABLE 2

| Specimen No. | Steel No. | Slab heating temp. (° C.) | Cumulative draft for 1050–950° C. (%) | Plate thickness (mm) | Direction (mm) | Product characteristics YS (MPa) | TS (MPa) | vE −20° C. (J) | Reproduced weld heat affected zone vE 0° C. (J) | Note |
|---|---|---|---|---|---|---|---|---|---|---|
| A-1 | A | 1100 | 50 | 40 | L | 355 | 524 | 310 | 193 | Inventive Example |
| | | | | | C | 358 | 528 | 305 | | |
| B-1 | B | 1150 | 40 | 40 | L | 366 | 535 | 302 | 216 | |
| | | | | | C | 370 | 539 | 290 | | |
| C-1 | C | 1150 | 40 | 60 | L | 364 | 549 | 286 | 225 | |
| | | | | | C | 363 | 545 | 272 | | |
| D-1 | D | 1150 | 40 | 60 | L | 370 | 551 | 280 | 180 | |
| | | | | | C | 373 | 548 | 286 | | |
| E-1 | E | 1200 | 30 | 60 | L | 374 | 527 | 322 | 192 | |
| | | | | | C | 372 | 525 | 301 | | |
| F-1 | F | 1150 | 40 | 60 | L | 357 | 530 | 285 | 185 | |
| | | | | | C | 360 | 538 | 272 | | |
| G-1 | G | 1150 | 50 | 80 | L | 377 | 570 | 262 | 192 | |
| | | | | | C | 374 | 568 | 251 | | |
| A-2 | A | 1270 | 40 | 40 | L | 324 | 529 | 107 | 190 | Comparative Example |
| | | | | | C | 328 | 533 | 93 | | |
| B-2 | B | 1150 | 25 | 40 | L | 356 | 533 | 112 | 218 | |
| | | | | | C | 360 | 536 | 108 | | |

TABLE 2-continued

| Specimen No. | Steel No. | Slab heating temp. (° C.) | Cumulative draft for 1050–950° C. (%) | Plate thickness (mm) | Direction (mm) | Product characteristics YS (MPa) | TS (MPa) | vE −20° C. (J) | Reproduced weld heat affected zone vE 0° C. (J) | Note |
|---|---|---|---|---|---|---|---|---|---|---|
| C-2 | C | 1280 | 30 | 60 | L | 324 | 559 | 106 | 205 | |
| | | | | | C | 320 | 556 | 99 | | |
| D-2 | D | 1150 | 20 | 60 | L | 369 | 552 | 133 | 183 | |
| | | | | | C | 372 | 550 | 126 | | |
| H-1 | H | 1150 | 30 | 40 | L | 427 | 569 | 90 | 45 | |
| | | | | | C | 418 | 562 | 84 | | |
| J-1 | J | 1150 | 40 | 40 | L | 425 | 572 | 115 | 38 | |
| | | | | | C | 414 | 567 | 102 | | |
| P-1 | P | 1170 | 40 | 40 | L | 368 | 550 | 123 | 77 | |
| | | | | | C | 370 | 553 | 51 | | |

For each of the obtained steel plates, tensile test pieces and Charpy impact test pieces were sampled from a central portion along the thickness of the plate and a tensile test and a Charpy impact test were conducted. Further, the Charpy impact test was conducted also on test pieces undergoing heat cycles with the highest heating temperature at 1400° C. and 30 seconds of cooling period at a temperature of 800 to 500° C. for reproducing heat affected zones by welding.

The results obtained in each of the tests are also shown in TABLE 2. As is apparent from TABLE 2, in the examples of the invention, no surface cracks were formed in the casting slab, and the yield strength (YS) was 325 MPa or more, the tensile strength (TS) was 490 MPa or more and the Charpy impact absorption energy at −20° C. (vE−20) was 200 J or more as the desired properties. For the tensile strength TS, a value of 520 MPa as a preferred level was also obtained. Further, the impact absorption energy at 0° C. (vE0) in the heat affected zones formed by welding was 110 J or more. That is, the examples satisfied all of the desired properties and showed excellent strength and toughness.

In contrast, in the Comparative Examples H–N, the strength and the toughness were not completely sufficient and, in addition, surface cracks were formed in all of the casting slab.

As explained above, according to the invention, continuous casting slab as the raw material for non-tempered high tensile steel materials having a tensile strength of 490 MPa or more can be obtained without forming surface cracks. Then, according to the invention, products having both excellent strength and toughness can be produced without adding a large amount of expensive elements, with no requirement of large rolling reduction at low temperature. In addition, the products can be made without industrial problems.

The non-tempered high tensile steel materials can form, for example, steel plates, hoops, sections and steel bars. The non-tempered high tensile steel materials can be utilized, for example, in buildings, bridge beams, marine structures, pipings, ship buildings, storage tanks, civil engineering and construction machines.

What is claimed is:

1. A steel continuous casting slab with no surface cracks, comprising:

C: about 0.05 to 0.18 wt %, Si: about 0.6 wt % or less, Mn: about 0.80 to 1.80 wt %, P: about 0.030 wt % or less, S: less than 0.004 wt %, Al: about 0.050 wt % or less, V: about 0.04 to 0.15 wt % and N: about 0.0050 to 0.0150 wt %;

at least one of Ti: about 0.004 to 0.030 wt % and B: about 0.0003 to 0.0030 wt % within a range satisfying the following equation 1; and at least one of Ca: about 0.0010 to 0.0100 wt % and REM: about 0.0010 to 0.0100 wt % within a range satisfying the following equation 2, with the balance being iron and inevitable impurities:

$$5.0 \leqq [V](wt\ \%)/([N](wt\ \%)-0.292\times[Ti](wt\ \%)-1.295\times[B](wt\ \%)) \leqq 18.0 \quad 1$$

$$[Mn](wt\ \%)\times([S](wt\ \%)-0.8\times([Ca](wt\ \%)-110\times[Ca](wt\ \%)\times[O](wt\ \%))-0.25\times([REM](wt\ \%)-70\times[REM](wt\ \%)\times[O](wt\ \%)))\times 10^3 \leqq 0.75 \quad 2.$$

2. The steel continuous casting slab of claim 1, further comprising at least one of Cu: about 0.05 to 0.50 wt %, Ni: about 0.05 to 0.50 wt %, Cr: about 0.05 to 0.50 wt %, and Mo: about 0.02 to 0.20 wt %.

3. The steel continuous casting slab of claim 1, further comprising from about 0.003 to 0.030 wt % of Nb.

4. A non-tempered high tensile steel article formed from the steel continuous casting slab according to claim 1.

5. The non-tempered high tensile strength steel article of claim 4, wherein the article is a plate.

6. The non-tempered high tensile strength steel article of claim 5, characterized as having a yield strength of at least about 325 MPa, a tensile strength of at least about 490 MPa and a Charpy impact absorption energy at −20° C. of at least about 200 J.

7. The non-tempered high tensile strength steel article of claim 4, wherein the article is a bar.

8. The non-tempered high tensile strength steel article of claim 7, characterized as having a yield strength of at least about 325 MPa, a tensile strength of at least about 490 MPa and a Charpy impact absorption energy at −20° of at least about 200 J.

9. A method of manufacturing a non-tempered high tensile steel material, comprising:

providing a steel continuous casting slab with no surface cracks comprising vanadium and nitrogen;

heating the steel continuous casting slab; and hot working the steel continuous casting slab to form a non-tempered high tensile steel material;

wherein the steel material having a yield strength of at least about 325 MPa, a tensile strength of at least about 490 MPa and a Charpy impact absorption energy at −20° C. of at least about 200 J;

wherein the steel continuous casting slab comprises:

C: about 0.05 to 0.18 wt %, Si: about 0.6 wt % or less, Mn: about 0.80 to 1.80 wt %, P: about 0.030 wt % or less, S: less than 0.004 wt %, Al: about 0.050 wt % or less, V: about 0.04 to 0.15 wt % and N: about 0.0050 to 0.0150 wt %;

at least one of Ti: about 0.004 to 0.030 wt % and B: about 0.0003 to 0.0030 wt % within a range satisfying the following equation 1; and at least one of Ca: about 0.0010 to 0.0100 wt % and REM: about 0.0010 to 0.0100 wt % within a range satisfying the following equation 2, with the balance being iron and inevitable impurities:

$$5.0 \leqq [V](wt\ \%)/([N](wt\ \%)-0.292\times[Ti](wt\ \%)-1.295\times[B](wt\ \%)) \leqq 18.0 \quad 1$$

$$[Mn](wt\ \%)\times([S](wt\ \%)-0.8\times([Ca](wt\ \%)-110\times[Ca](wt\ \%)\times[O](wt\ \%))-0.25\times([REM](wt\ \%)-70\times[REM](wt\ \%)\times[O](wt\ \%)))\times 10^3 \leqq 0.75 \quad 2.$$

10. The method of claim 9, wherein the steel material has a tensile strength is at least about 520 MPa.

11. The method of claim 9, wherein the steel material has an impact absorption energy at 0° C. in a heat affected zone formed by welding of at least about 110 J.

12. The method of claim 9, wherein the steel continuous casting slab comprises from about 0.04 to 0.15 wt % V and from about 0.0050 to 0.0150 wt % N.

13. A method of manufacturing a non-tempered high tensile steel material, comprising:

heating a continuous casting slab to a temperature of from about 1050° C. to 1250° C.; and hot working the continuous casting slab with a cumulative draft of at least 30% within the temperature range of from about 1050 to 950° C., wherein the continuous casting slab comprising:

C: about 0.05 to 0.18 wt %, Si: about 0.6 wt % or less, Mn: about 0.80 to 1.80 wt %, P: about 0.030 wt % or less, S: less than 0.004 wt %, Al: about 0.050 wt % or less, V: about 0.04 to 0.15 wt % and N: about 0.0050 to 0.0150 wt %;

at least one of Ti: about 0.004 to 0.030 wt % and B: about 0.0003 to 0.0030 wt % within a range satisfying the following equation 1;

and at least one of Ca: about 0.0010 to 0.0100 wt % and REM: about 0.0010 to 0.0100 wt % within a range satisfying the following equation 2;

$$5.0 \leqq [V](wt\ \%)/([N](wt\ \%)-0.292\times[Ti](wt\ \%)-1.295\times[B](wt\ \%)) \leqq 18.0 \quad 1$$

$$[Mn](wt\ \%)\times([S](wt\ \%)-0.8\times([Ca](wt\ \%)-110\times[Ca](wt\ \%)\times[O](wt\ \%))-0.25\times([REM](wt\ \%)-70\times[REM](wt\ \%)\times[O](wt\ \%)))\times 10^3 \leqq 0.75 \quad 2.$$

* * * * *